United States Patent [19]

Freedman et al.

[11] Patent Number: 4,629,865

[45] Date of Patent: Dec. 16, 1986

[54] ELECTRIC OVEN WITH IMPROVED BROILER

[75] Inventors: George Freedman, Wayland; Robert F. Bowen, Burlington; Kenneth W. Dudley, Sudbury, all of Mass.

[73] Assignee: Raytheon Company, Lexington, Mass.

[21] Appl. No.: 694,192

[22] Filed: Jan. 23, 1985

[51] Int. Cl.[4] ..... F24C 7/06

[52] U.S. Cl. ..... 219/405; 219/392; 219/399

[58] Field of Search ..... 219/391, 392, 393, 405, 219/411, 412, 385, 386, 413, 395–399

[56] References Cited

U.S. PATENT DOCUMENTS

| | | | |
|---|---|---|---|
| 2,922,018 | 1/1960 | Walkoe | 219/393 |
| 2,935,594 | 5/1960 | Christenson | 219/412 |
| 2,981,819 | 4/1961 | Gregory | 219/405 |
| 3,240,915 | 3/1966 | Carter | 219/405 |
| 3,241,545 | 3/1966 | Reinert | 219/393 |
| 3,327,094 | 6/1967 | Martin | 219/405 |
| 3,836,751 | 9/1974 | Anderson | 219/405 |
| 4,020,323 | 4/1977 | Dills | 219/405 |
| 4,163,894 | 8/1979 | Scherer | 219/393 |
| 4,307,285 | 12/1981 | DeRemer | 219/392 |

OTHER PUBLICATIONS

Brochure: Modern Maid Electric Closed Door Smokeless Broiling, Modern Maid Kitchen Appliance Div., McGraw Edison Co., 12/78.

Blueprint: Smoke Eliminator, Modern Maid Inc., Chattanooga, Tenn, 37401, 8/17/70.

*Primary Examiner*—E. A. Goldberg

*Assistant Examiner*—Teresa J. Walberg

*Attorney, Agent, or Firm*—William R. Clark; Richard M. Sharkansky

[57] ABSTRACT

An electric oven including a broiler having a concentrator or reflector for providing more effective and efficient broiling. The broiling element is recessed into a downward facing trough of the aluminized steel concentrator. The broiling element has a plurality of parallel segments interconnected by curved end segments, and the shape of the trough is conforming. In operation, energy that would otherwise radiate to the cavity ceiling and side walls impinges the trough. A portion of the impinging energy is reflected downwards towards the food and another portion is absorbed by the concentrator causing it to heat and thereby become a source of thermal energy for the food.

18 Claims, 13 Drawing Figures

ELECTRIC OVEN WITH IMPROVED BROILER

BACKGROUND OF THE INVENTION

The field of the invention relates to a broiler for an electric oven.

Typically, domestic electric ovens have a bake heating element positioned adjacent and parallel to the cavity floor and a broiling heating element positioned adjacent and parallel to the cavity ceiling. When baking, the desired oven cavity temperature, such as 350° F., is selected by the operator and then the bake element is activated to raise the entire cavity including the walls and the air to that selected temperature. Then, in response to a cavity temperature sensor, the bake element is cycled on and off to maintain that selected temperature. Although the broiling element may also be cycled on and off at a reduced power level during the bake cycle to lightly brown the surface of certain foods such as cakes, baking predominantly results from heat which is transferred to the food from the air.

When broiling, the broiling element is continuously activated at full power and the bake element is not used. Typically, after preheating the bake element, the food, such as steaks or hamburgers, is placed on a slotted broiling pan and positioned on an upper rack near the broiling element. As is well known, broiling is accomplished by utilizing the principle of radiant heat transfer. More specifically, rather than heating the cavity air to some temperature as done with baking, the heating of the food during broiling results predominantly from infrared energy radiating from the broiling element to the surface of the food. After the food is cooked on one side, it is turned over and the other side is exposed to the radiant energy from the broiling element.

A significant disadvantage of electric oven broilers has been that they don't provide enough radiant energy to the food to produce optimum broiling. For example, rather than providing enough radiant energy to rapidly brown the surface of meat so as to sear the juices in and leave the center of the meat less brown or pink, electric broilers typically cook much slower so that the surface never gets to a searing temperature and the heat has time to conduct inwardly thereby producing a center which is almost as dark as the surface. Accordingly, to prevent overcooking the interior, the surface has to be left at a relatively light color which is not as palatable as charcoal cooking. The poor performance of prior art electric oven broilers is emphasized when they are compared to gas oven broilers having a mesh that is rapidly heated to a relatively high incandescent temperature by the gas flames. The mesh produces substantial infrared radiant energy for rapidly searing meat.

SUMMARY OF THE INVENTION

It is an object of the invention to provide an improved broiler for an electric oven. More specifically, it is an object to provide a broiler that concentrates the radiant energy from the electric broiling rod in a downward direction to increase the radiant energy incident upon the food.

It is another object to provide a high efficiency electric broiler that provides downward radiant energy sufficient to char the outside of meat such as steaks while searing in the juices in a pink interior.

These and other objects are provided in accordance with the invention which defines an electric oven comprising an oven cavity, a contoured concentrator defining a downward facing trough positioned near the top of the cavity, an elongated electric heating element having at least a section recessed within the trough, and means for activating the heating element. The concentrator may preferably be fabricated from an aluminized steel sheet. The heating element may preferably be a serpentine rod activated to provide radiant energy for broiling. Generally, the concentrator increases the downward radiant energy for broiling. More specifically, radiant energy from the heating element that is initially directed in an upward or sideward direction impinges the trough of the contoured concentrator thereby preventing its further radiation to the ceiling or side walls of the cavity. The concentrator may increase the downward radiation by either reflecting the impinging radiation, absorbing the impinging radiation so as to heat and become a source of radiation, or both.

The invention may further be practiced with an electric oven comprising an oven cavity having a contoured ceiling defining a downwardly facing trough, an electric heating element recessed within the trough, and means for activating the electric heating element. Preferably, the trough and the heating element define a serpentine shape and the heating element is activated for providing radiant energy to broil food. Also, it is preferable that at least a portion of the cross-section of the trough define a parabolic shape.

The invention further defines an electric oven comprising an oven cavity, an elongated resistive heating element disposed in a substantially horizontal plane adjacently spaced from the top of the cavity, means for activating the heating element, and means spaced from and surrounding the top and sides of the heating element for concentrating radiant energy emanating from the heating element in a downward direction for broiling food.

The invention may further be practiced by an electric oven comprising an oven cavity, a contoured metal concentrator having a serpentine-shaped downwardly facing trough, a rod-like electric broiling element having a section substantially conforming to the shape of the serpentine trough, the section being recessed within the trough and connected thereto wherein a portion of the energy radiated from the broiling element in an upward or sideward direction is reflected to a downward direction, and means for activating the broiling element. It may be preferable that the serpentine-shaped trough have a plurality of parallel segments interconnected at the ends with curved segments.

The invention further defines an electric oven comprising an oven cavity having a ceiling, side and back walls, a floor, and a front door, an electric broiling rod disposed in a substantially horizontal plane adjacently spaced from the ceiling of the cavity, the broiling rod having a plurality of parallel segments, means for activating the broiling rod to produce radiant energy, and a shield spaced from and individually wrapped around the top and sides of the segments to prevent the radiant energy from the broiling rod radiating to the ceiling and the side walls, the shield reflecting a portion of the radiant energy in a downward direction and absorbing a portion of the radiant energy thereby raising the temperature of the shield wherein the shield becomes a source of downwardly directed radiant energy.

The invention further defines an electric oven comprising an oven cavity defined by side walls, a back wall, a ceiling, a floor, and a front door, a first elongated resistive heating element curvedly disposed in a substantially horizontal plane adjacently spaced from the floor, means for providing an electric current through the first heating element, a second elongated resistive heating element curvedly disposed in a substantially horizontal plane adjacently spaced from the ceiling, a portion of the second heating element having a serpentine shape defined by a plurality of parallel segments interconnected by curved end segments, means for providing electric current through the second heating element, and a contoured aluminized steel concentrator defining a downward facing trough substantially conforming to the serpentine shape, the second heating element being recessed up in the trough to concentrate radiant energy from the second heating element downwardly. "Serpentine shape" may generally be defined to be a nonlinear rod having two ends. Preferably, the trough may have a parabolic cross-section with an entrance wider than an inch and a height less than an inch. Also, it is preferable that the entrance be at least four times wider than the cross-section or diameter of the second heating element. Also, it is preferable that the element be recessed up into the trough approximately one-third of the height of the trough.

Further, the invention may be practiced by an oven cavity defined by side walls, a back wall, a floor, a ceiling, and a front door, an electric broiling rod disposed in a substantially horizontal plane adjacent to the ceiling of the cavity, the rod having a plurality of interconnected segments, means for activating the broiling rod to provide radiant energy, and a plurality of downward facing metal troughs respectively positioned between the plurality of broiling rod segments and the ceiling, the troughs having sides spaced from and extending downwardly past the respective broiling rod segments wherein the radiant energy emitted from the segments in a direction having an upward vertical or strongly horizontal component impinges the troughs, the troughs reflecting a portion of the impinging radiant energy in a downward direction.

BRIEF DESCRIPTION OF THE DRAWINGS

The foregoing objects and advantages of the invention will be more fully understood by reading the Description of the Preferred Embodiment with reference to the drawings wherein.

DESCRIPTION OF THE PREFERRED EMBODIMENT

Figure 1:
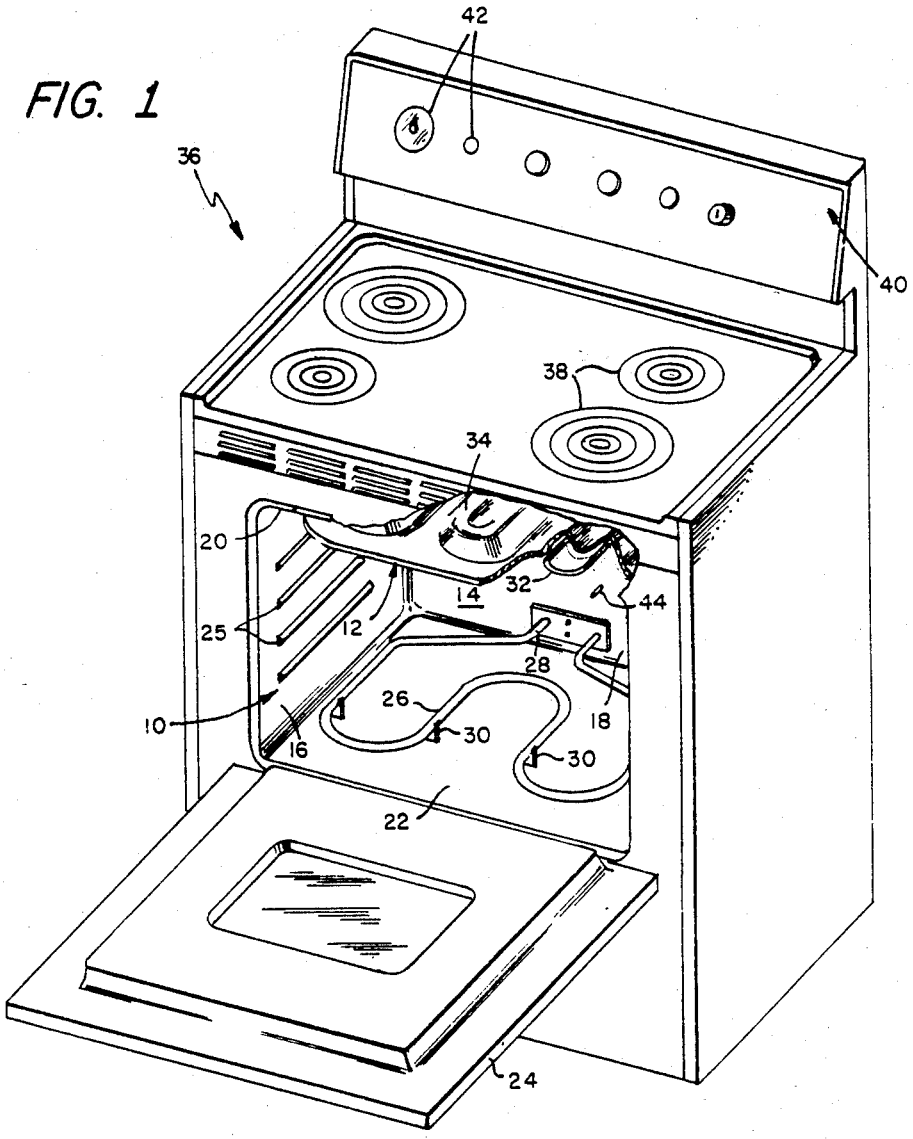
FIG. 1 is a partially broken away front perspective of an electric range including the improved oven.

Referring to FIG. 1, a partially broken-away perspective view of electric oven 10 housing directive or concentrating broiler 12 is shown. The cavity 14 of oven 10 includes side walls 16, back wall 18, ceiling 20, floor 22 and door 24. Side walls 16 are formed to define a plurality of pairs of guides 25 or channels on opposing walls into which food support racks 27 (FIG. 2) are slidably engaged. Positioned in a horizontal plane adjacent to floor 22 is bake element 26 or bake rod which is an elongated sheathed electric resistive heating element. In conventional manner, bake element 26 has two terminals 28 coupled from back wall 18 and is supported by stands 30. Positioned in a horizontal plane adjacent to ceiling 20 is broil element 32 or broil rod which is an elongated sheathed electric resistive heating element. As will be described in detail later herein in accordance with the invention, broiler 12 includes concentrator 34 or reflector in addition to broil element 32. Although oven 10 is here shown embodied in free-standing range 36 which also includes surface electric heating elements 38, broiler 12 may be used to advantage in accordance with the invention in other types of ovens such as, for example, portable countertop ovens, wall ovens, or built-in ovens.

Still referring to FIG. 1, control panel 40 has control knobs 42 which are used in conventional manner to control the operation of bake element 26, broil element 32, and, in the embodiment shown in FIG. 1, surface elements 38. As an example, operational modes of oven 10 are typically bake, broil, and preferably self-clean. In bake operation, bake element 26 is normally activated at full power by applying maximum voltage such as 240 volts AC across its terminals 28. It may also be preferable to activate broil element 32 at reduced power during bake operation to lightly brown the upper surface of such foods as cakes. As is conventional, temperature sensor 44 is used to cycle bake element 26 and broil element 32 on and off to maintain cavity 14 at approximately the operator selected bake temperature. In broil operation, only broil element 32 is turned on and it is activated at full power by 240 volts AC. In self-clean operation, both bake element 26 and broil element 32 may typically be activated; either or both may be at reduced voltage or reduced duty cycle.

Figure 2:
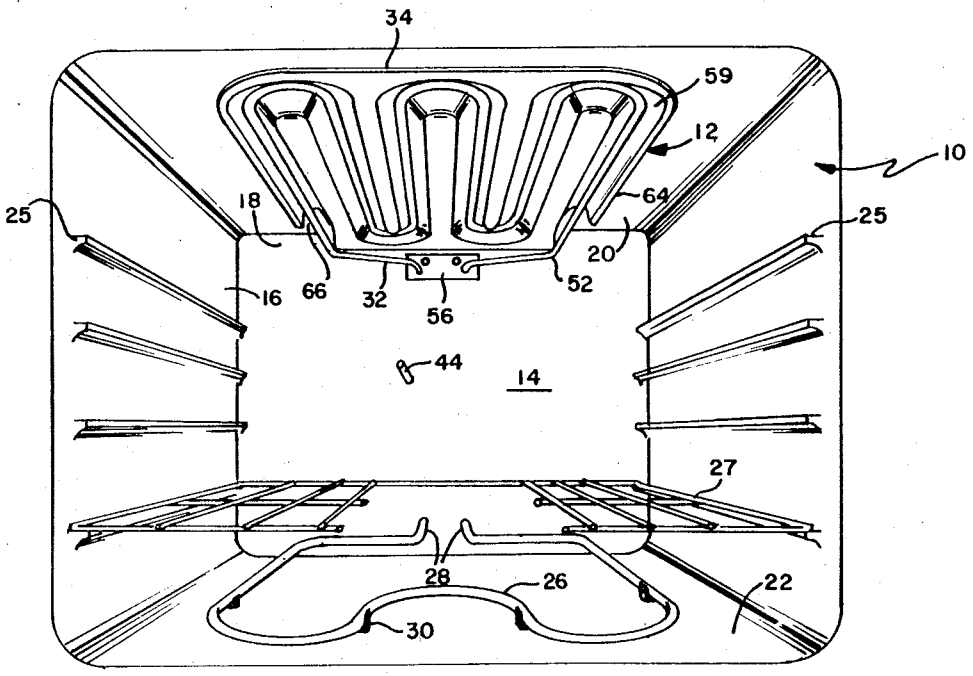
FIG. 2 is a front perspective view of the oven of FIG. 1.
Figure 3:
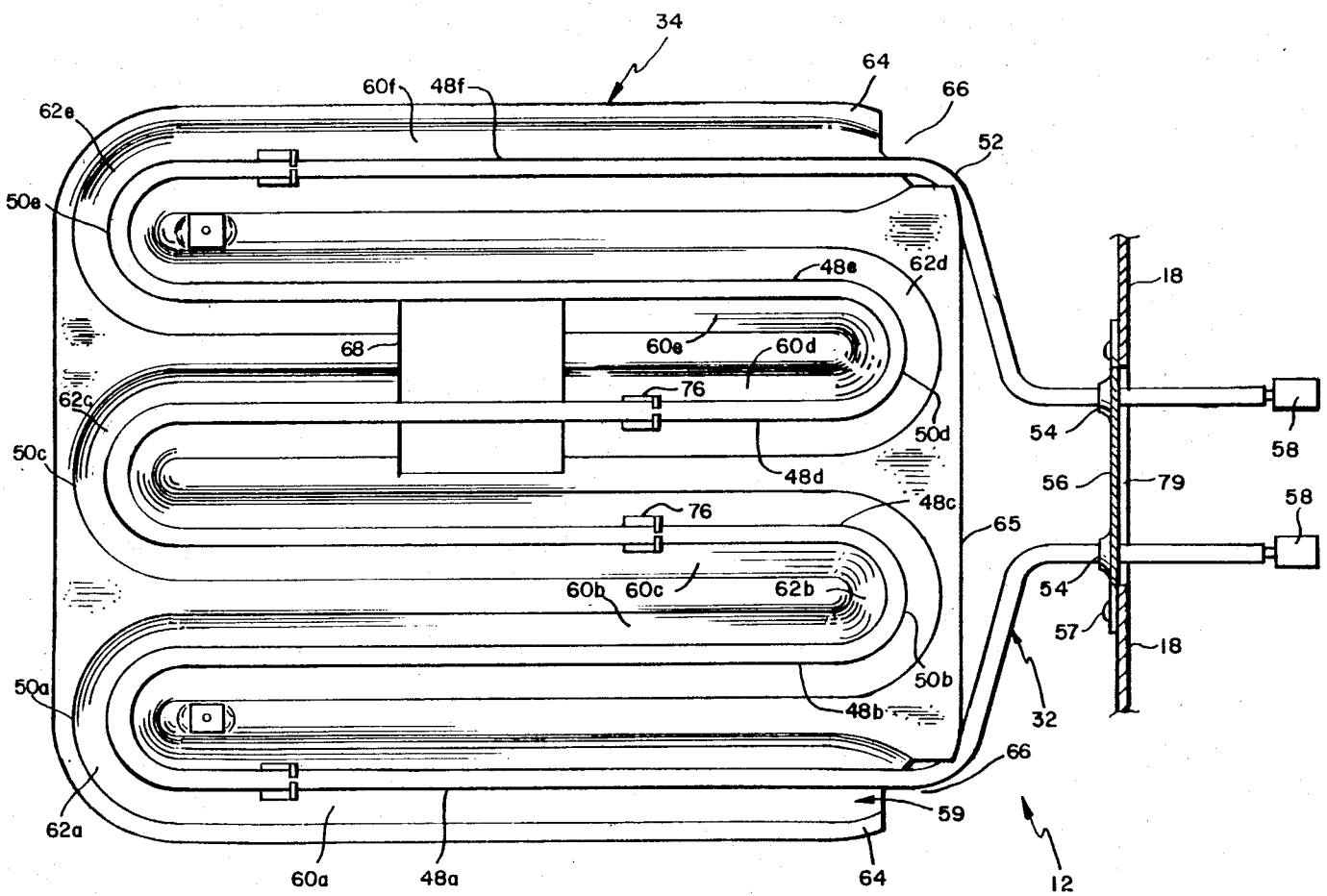
FIG. 3 is a bottom plan view of the broiler of FIG. 1.
Figure 4:
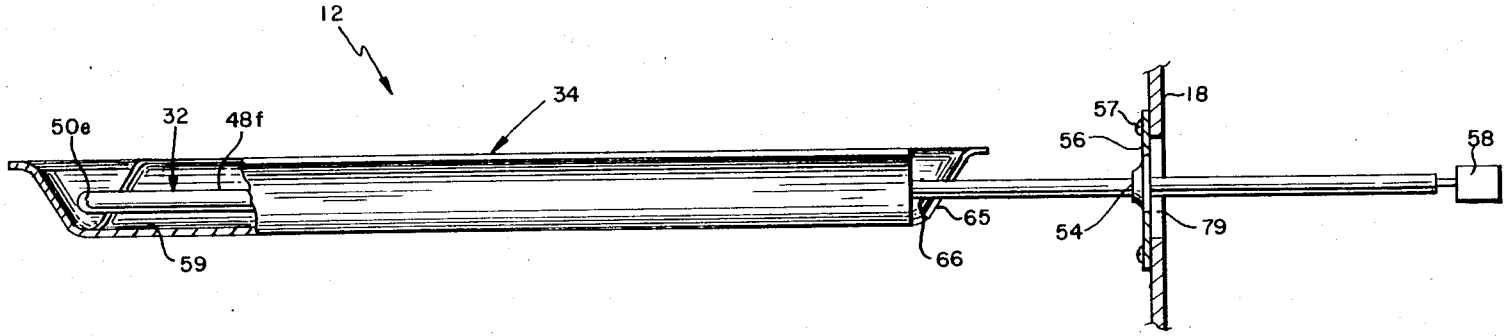
FIG. 4 is a partially broken away side view of the broiler.

Referring to FIG. 2, a front perspective view into cavity 14 is shown. Like parts as described with reference to the other drawings are identified by like numerals. FIGS. 3 and 4 respectively show bottom and partially broken-away side views of concentrating broiler 12 which includes broiler element 32 and concentrator 34 or reflector. Broil element 32 generally defines any suitable electrically activated heating element. As shown in FIGS. 2–4, broil element 32 may typically be a conventional horizontally disposed serpentine rod having six parallel hot segments 48*a*–*f* interconnected by rounded or curved hot end segments 50*a*–*e*. In one exemplary embodiment, parallel segments 48*b*–*e* are approximately 9 inches in length and the curved end segments 50*a*–*e* have radii of approximately 0.86 inches. Parallel segments 48*a* and 48*f* may preferably have a hot length of approximately 10 inches and extend another inch to inward curves 52 so as to be parallelly spaced by approximately 1.75 inches for insertion through apertures 54 in mounting bracket 56. Mounting bracket 56 is connected by suitable means such as screws 57 to back wall 18 and broil element 32 extends to terminals 58 which are connected to a source of AC voltage. The diameter of broil element 32 may typically be approximately 0.26 inches. The rating of broil element 32 may commonly be approximately 3 kilowatts at 240 volts AC. Those skilled in the art will recognize that other shapes and sizes of broil elements 32 could be used. As will be apparent later herein, however, the geometrical relationship between broil element 32 and concentrator 34 is important.

Still referring to FIGS. 2–4, concentrator 34 is a metallic sheet contoured to define a downward facing trough 59, channel or furrow substantially conforming to the hot or heating portion of broil element 32. For broil element 32 as shown and described, downward facing trough 59 has a serpentine shape defined by six parallel segments 60*a–f* interconnected by curved or rounded end segments 62*a–e*. Preferably, the contour of concentrator 34 may be formed by stamping and, as such, it may be desirable to have rim 64 wrap around the back side 65 with two notches 66 for routing parallel segments 48*a* and 48*f* into trough segments 60*a* and 60*f*. Aperture 68 is provided in concentrator 34 so that a conventional oven ceiling light (not shown) can be used. As an alternate embodiment, the oven light could be located at the side of concentrator 34 or in one of the horizontal walls 16 or 18.

Figure 5:
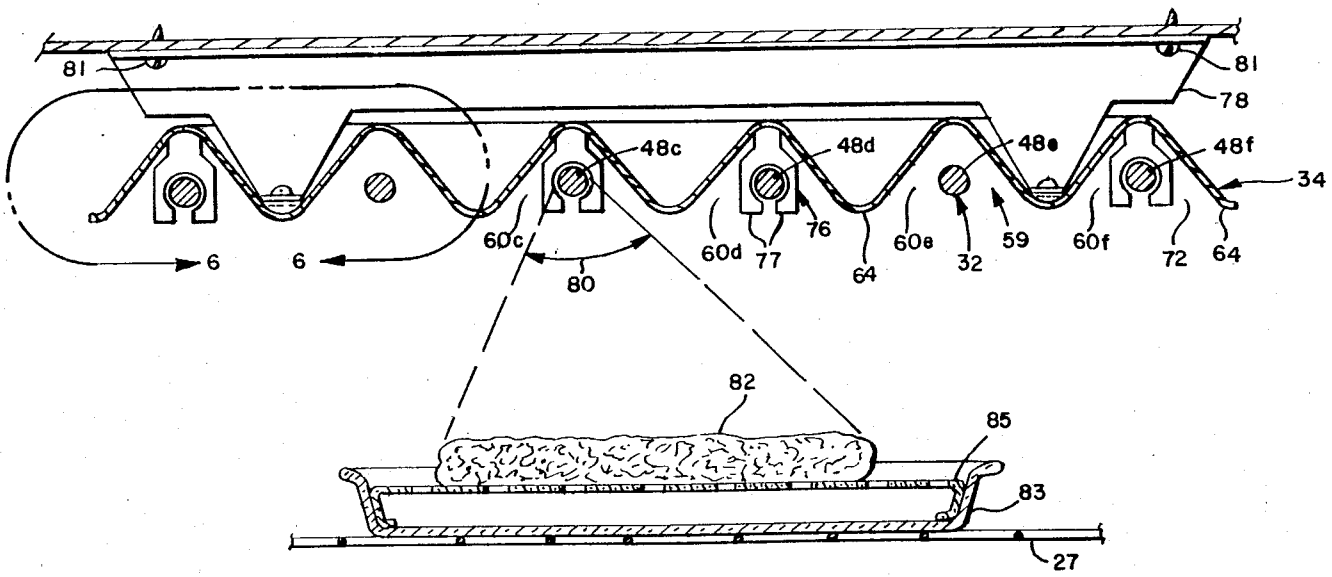
FIG. 5 is a sectioned front view of the broiler.
Figure 6:
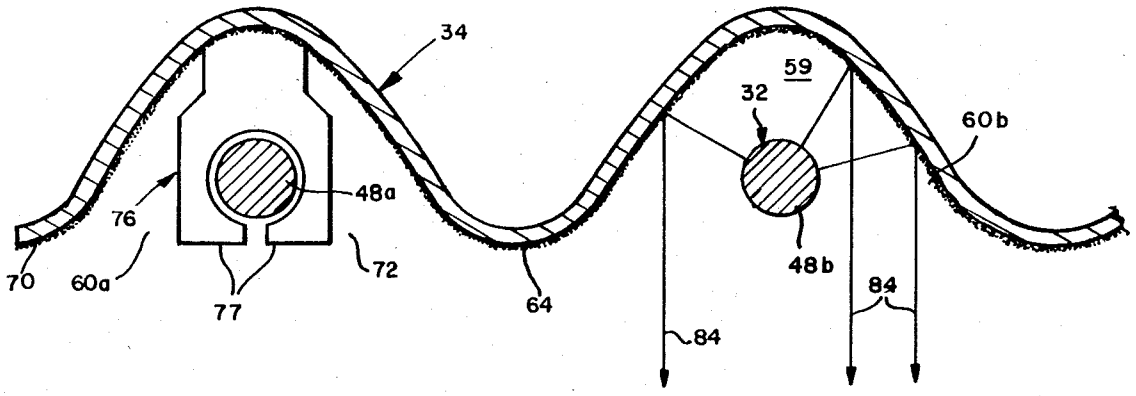
FIG. 6 is an expanded view of the region within line 6—6 of FIG. 5.

Referring to FIG. 5, a front sectioned view of concentrator 34 is shown. FIG. 6 is an expanded view of the region within line 6—6 of FIG. 5. Concentrator 34 is fabricated out of aluminized steel and therefore has a thin surface layer 70 of aluminum to provide improved reflection characteristics. Ideally, trough 59 has a parabolic cross-section for maximum downward directivity of infrared radiation from heating element 32 by reflection. However, as will be described later herein, concentrators 34 having other cross-sectional shapes provide broiling performances that are significantly better than without using any concentrator. Here, rims 64 or cusps between parallel trough segments 60*a–f* are spaced approximately 1.72 inches apart so as to conform with the shape of broil element 32. Accordingly, the entrances 72 into troughs 59 are at least four and preferably six times greater than the diameter of broil element 32. The height of trough 59 from its entrance 72 is approximately 0.80 inches and the axial center of broil element 32 is approximately 0.27 inches from entrance 72. Stated differently, broil element 32 is recessed approximately one-third of the distance in trough 59.

In fabrication, a plurality of broil element fasteners 76 are connected in trough 59 by suitable means such as, for example, rivets. Broil element 32 is then positioned in trough 59 as shown and the legs 77 of fasteners 76 are twisted to the configuration shown to clamp around broil element 32 holding it securely in substantially central alignment within trough 59. A reflector mounting bracket 78 is connected to the top side of reflector 46 by suitable means such as rivets. To install broiler 12 in cavity 14, the terminals 58 of broil element 32 are inserted through a hole 79 in back wall 18 to an electrical receptacle (not shown) and mounting bracket 56 is attached to back wall 18 in conventional manner. Next, reflector mounting bracket 78 is attached to ceiling 20 by suitable means such as sheet metal screws 81.

In broiling operation, an AC voltage such as 240 volts AC is applied across terminals 58 of broiling element 32 in conventional manner. Being a resistive heating element, electric current flows through broiling heating element 32 thereby producing heat in the hot region. As is well known, the temperature of broiling element 32 continues to rise until an equilibrium is reached between the heat being added to it and lost from it. Typically, a stable temperature is reached in a conventional broiling element 32 in the range from 1500° F. to 1700° F. At this temperature, most of the heat lost from heating element 32 is by infrared radiation. Without reflector or concentrator 34, only a small fraction of this radiant energy would be incident upon or absorbed by the food 82 such as a steak. More specifically, since the broil element 32 has a circular cross-section, it substantially radiates omnidirectionally and only that part directed at the food would be absorbed without reflection. Specifically, arc 80 in FIG. 5 approximately shows in one dimension the radiated energy that would be directly incident upon food 82. The size of arc 80 would be a function of the upper surface area of the food and its distance from broil element 32; it is apparent that the energy in arc 80 would generally be substantially less than 50 percent of the total energy radiated from broil element 32. Without concentrator 34, all of the rest of the radiated energy would impinge the walls 16, 18, 20 and 22, and door 24. Some of this energy would be reflected but, due to the reflectivity of those walls, most would be absorbed. Accordingly, without concentrator 34, most of the energy radiated from broil element 32 would not contribute to the broiling process but merely heat the cavity walls. It is noted that while baking requires raising the temperature of the air in the cavity, broiling predominantly results from the transfer of infrared radiation and it is optimally and efficiently accomplished without heating the walls and air.

In accordance with the invention, a substantial portion of the energy radiated with an upward or strong horizontal component from broil element 32 is reflected or redirected in a generally downward direction thereby providing not only more efficient but significantly improved broiling. Specifically, in spite of the evaporative, conduction and convection heat losses on the surface of meat, the impinging radiant energy is sufficient to drive the surface to a temperature that chars and provides visible browning while searing in the flavor and juices in a pink interior. Stated differently, the broiling is rapid enough so that the surface is charred or darkly browned before the heat conducts to the interior in an amount substantial enough to cook it in like manner. The thickness of the food and its desired doneness determine the broiling time and the position of oven rack 27. As one example, oven racks 27 may be spaced 3.75, 5.75, 7.75 and 9.75 inches, respectively, from broiling element 32. Broiling pan 83 which rests on one of the racks 27 may also provide adjustability in the spacing of food 82 from broil element 32. Broiling pan 83 should have a slotted tray 85 to isolate drippings such as grease from the broiling temperatures.

Comparative tests were conducted to evaluate the improvement in broiling with concentrator 34 as contrasted to broiling without a concentrator. Representative broiling times are presented in the Table below.

TABLE

| | | BROILING TIME (MIN.) | |
|---|---|---|---|
| FOOD | THICKNESS (INCHES) | WITH CONCEN-TRATOR | WITHOUT CONCENTRATOR |
| Hamburger | 0.75 | 8 | 15 |
| Steak | 1.0 | 10 | 21 |

TABLE-continued

| FOOD | THICKNESS (INCHES) | BROILING TIME (MIN.) WITH CONCENTRATOR | WITHOUT CONCENTRATOR |
|---|---|---|---|
| Steak | 1.5 | 14 | 27 |
| Chicken Broiler Halves | | 30 | 36 |

As is conventional in broiling, each food was cooked on one side and then turned over for cooking on the other side. The times in the Table are the sums of the cooking times on the two sides. For example, without using a concentrator, a one-inch steak required 12 minutes on the first side and 9 minutes on the second side for a total of 21 minutes to broil to medium doneness. The same doneness was provided with the concentrator by cooking on the first side for 6 minutes and on the second side for 4 minutes. The representative broiling times presented in the Table show a dramatic improvement in broiling performance when using concentrator 34. For example, the comparative broiling times using concentrator 34 for 0.75-inch hambergers, 1-inch steaks, 1.5 inch steaks, and chicken halves are reduced by approximately 47%, 52%, 48% and 17%, respectively. The final doneness and the distance from the broil element were the same in the comparative tests. The broil elements 32 were similar.

Theoretically, if downward facing trough 59 were a perfect parabola and broil element 32 were a line source positioned at the focus, all of the energy reflected from concentrator 34 would be directed vertically downward as depicted by the radiation lines 84 in FIG. 6. Accordingly, to optimize the performance and efficiency of concentrator 34, troughs 59 ideally have a parabolic shape at least to a point on their curve where they bend outwardly towards an adjacent trough 59 in the corrugated structure.

Figure 7A:
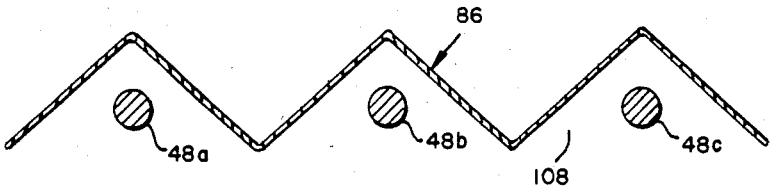
FIGS. 7A–7D are partial front sectioned views of alternate embodiments of the broiler.
Figure 7B:
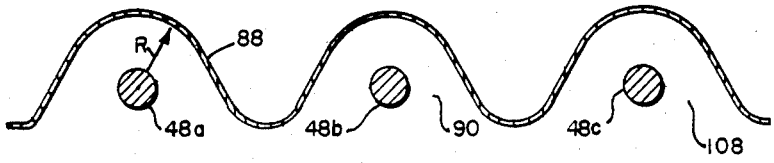
Figure 7C:
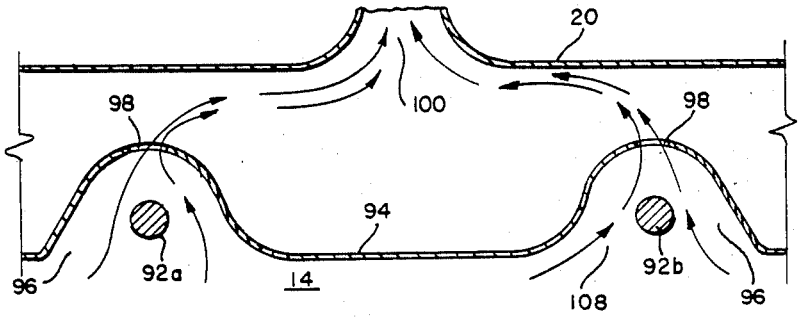
Figure 7D:
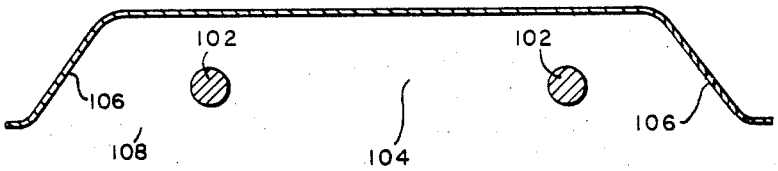

Referring to FIGS. 7A–D, front sectioned views of alternate embodiments of concentrator 34 are shown. FIG. 7A shows a sawtooth concentrator 86 with broil element segments 48*a–c* recessed therein. FIG. 7B shows concentrator 88 having a portion of troughs 90 defined by a cylindrical shape with radius R. FIG. 7C shows broil element segments 92*a* and 92*b* spaced a greater distance than those shown in FIGS. 7A and 7B and accordingly, a horizontal panel 94 separates troughs 96. Also, FIG. 7C shows slots 98 at the top of troughs 96 and an exhaust port 100 in the ceiling 20 of cavity 14 so that smoke can rise past the broil element segments 92*a* and 92*b* for exhaust through slots 98 and exhaust port 100. In FIGS. 7A–C, the broil element segments 48*a–c* and 92*a* and 92*b*, respectively, are at least partially surrounded by corresponding individual troughs. In FIG. 7D, however, two or more parallel broil element segments 102 are recessed in trough 104 having side skirts 106. Although the concentrator shapes of FIGS. 7A–D deviate from the ideal parabolic shape that reflects energy directly downward, they all function to greatly increase the radiation incident upon the food 82 and thereby they greatly improve broiling performance. Specifically, even though all of radiation from the concentrators shown in FIGS. 7A–7D is not in a downward vertical direction, the radiation would have a strong downward vertical component. In FIGS. 7A–D like FIGS. 2–4, each trough has an entrance 108 significantly larger than the diameter of the broiling element segment and the segment is recessed into the trough approximately one-third of the trough depth. In an alternate but less efficient embodiment, the broil element could be positioned outside of the trough so long as the entrance to the trough is substantially larger than the diameter of the broil element. As another alternate embodiment, a corrugated concentrator without end segments 62*a–e* could be used; although the downward energy from concentrator 34 might be reduced by approximately 40 percent, it would still provide broiling performance better than without any concentrator.

Figure 8:
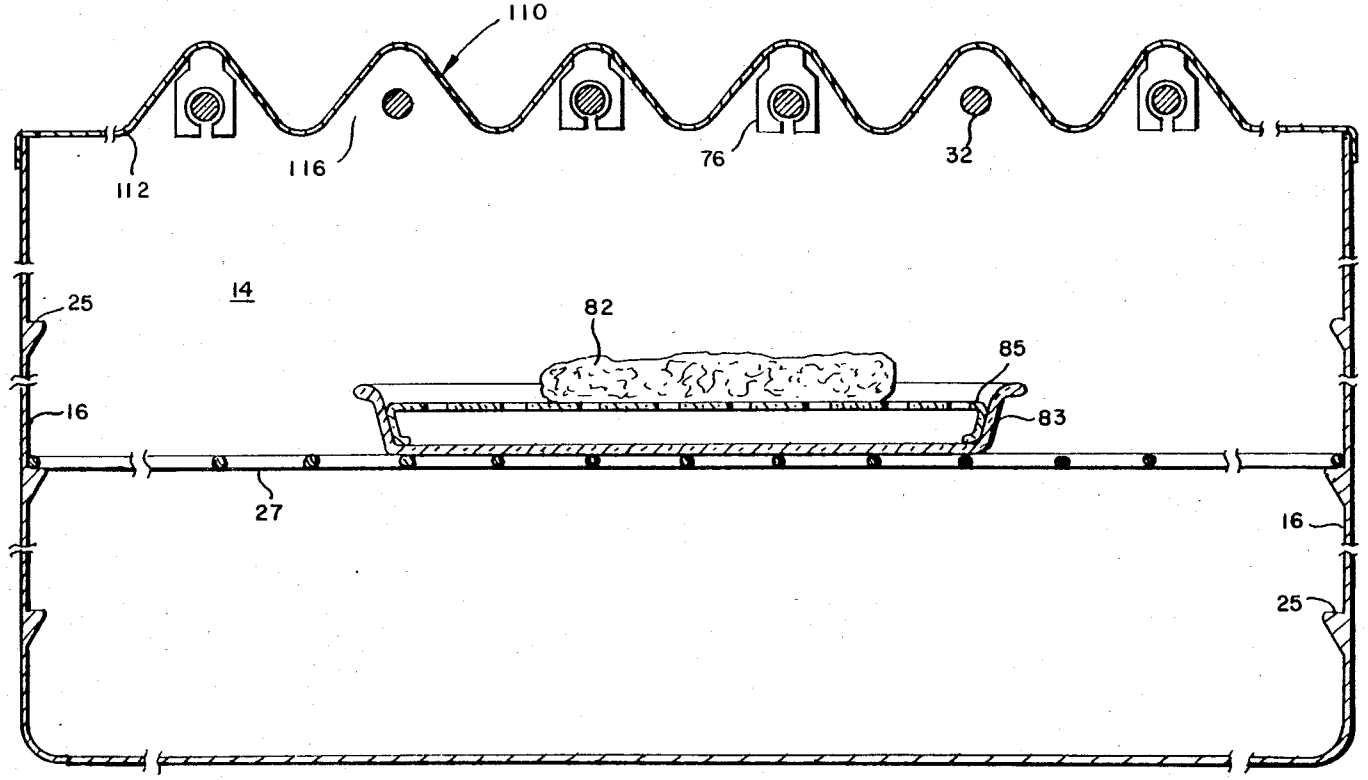
FIG. 8 is a front sectioned view of an alternate electric oven.

Referring to FIG. 8, a front sectioned view of an alternate embodiment of broiler 12 is shown. Concentrator 110 also functions as ceiling 20 of cavity 14. Stated differently, rather than inserting broiler 12 into cavity 14 and connecting it there, the ceiling 112 of cavity 114 is contoured to form concentrating troughs 116 and broil element 32 is recessed therein.

Although other materials could be used, concentrator 34 has been described as being fabricated of aluminized steel. More specifically, concentrator 34 may be die stamped from 0.039-inch thick sheet steel having a 0.001-inch aluminum silicon alloy hot dip coating or layer 70. Preferably, a new concentrator 34 reflects as much as 80 percent radiant heat up to 900° F. It is well known, however, that aluminized steel suffers surface degradation after exposure to high temperature. The reason for surface degradation is the interaction between the iron in the base steel material and the coating of aluminum. At temperatures above 900° F., iron and aluminum possess interdiffusion rates high enough to create an intermetallic compound between them. This compound, $FeAl_3$, forms at the surface causing it to darken to a light gray and eventually turn dark gray. Generally, as a metallic surface becomes less shiny and/or darker, its reflectivity decreases. Temperature is the key rate controlling variable as the intermetallic diffusion time varies exponentially with temperature. More specifically, if the temperature is below 1050° F., the intermetallic compound forms slowly; if the temperature is above 1100° F., however, the intermetallic compound forms quickly.

Figure 9:
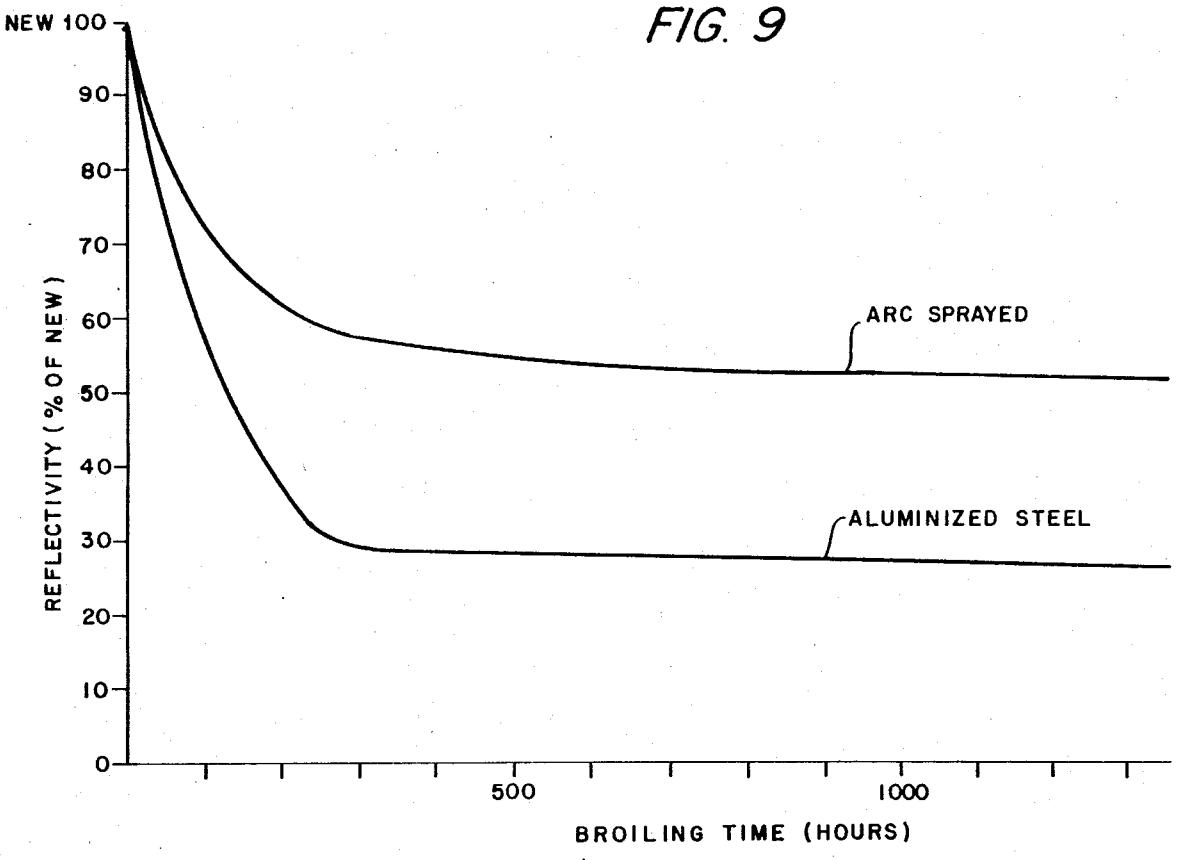
FIG. 9 shows representative plots of reflectivity during the life cycle of broilers.

Because uncertanties existed in the long-term reflectivity of aluminized steel, performance and life tests were conducted. Referring to FIG. 9, a representative curve shows the decrease in reflectivity of an aluminized steel concentrator from its new state. The broil element 32 of the concentrator 34 was continuously activated for a life test. Periodically, reflectivity measurements were taken using a reflectance meter. The aluminized steel degraded to about 26% of its original or new reflectivity after about 30 years of effective use (1560 continuous broiling hours). Those skilled in the art will recognize that, although more costly, one could make a concentrator 34 having higher initial reflectivity and/or reduced degradation of reflectivity resulting from high-temperature use. For example, concentrator 34 could be made from polished stainless steel which would not be subject to the formation of intermetallic compounds. Also, a diffusion barrier such as nickel could be deposited on the steel before the aluminum alloy coating was applied by hot dipping thereby retarding the formation of $FeAl_3$. Further, commercial quality aluminized steel could be plasma or arc sprayed to increase the thickness of the aluminum layer 70 thereby reducing the migration of $FeAl_3$ to the surface. A second curve in FIG. 9 shows that the reflectivity of an arc sprayed sample only degraded by approximately 52% over an extended life cycle. It was found, however, that use of materials other than aluminized steel to increase or preserve the light metallic appearance and therefore high reflectivity of the concentrator was not particularly warranted in view of their cost because they only improved broiling performance by a slight degree. More specifically, while it took 7 minutes to cook a hamburger with a new highly reflective concentrator 34, it only took 7.5 minutes or a time increase of 7% to cook an identical hamburger to the same doneness under the same controlled conditions using a significantly darkened aluminized steel concentrator 34 having the equivalent of 30 years use. An explanation for why the increase in cooking time was so small will be given later herein. At the end of the cooking cycle, the new concentrator 34 was 875° F. and the darkened concentrator was 975° F.

Figure 10:
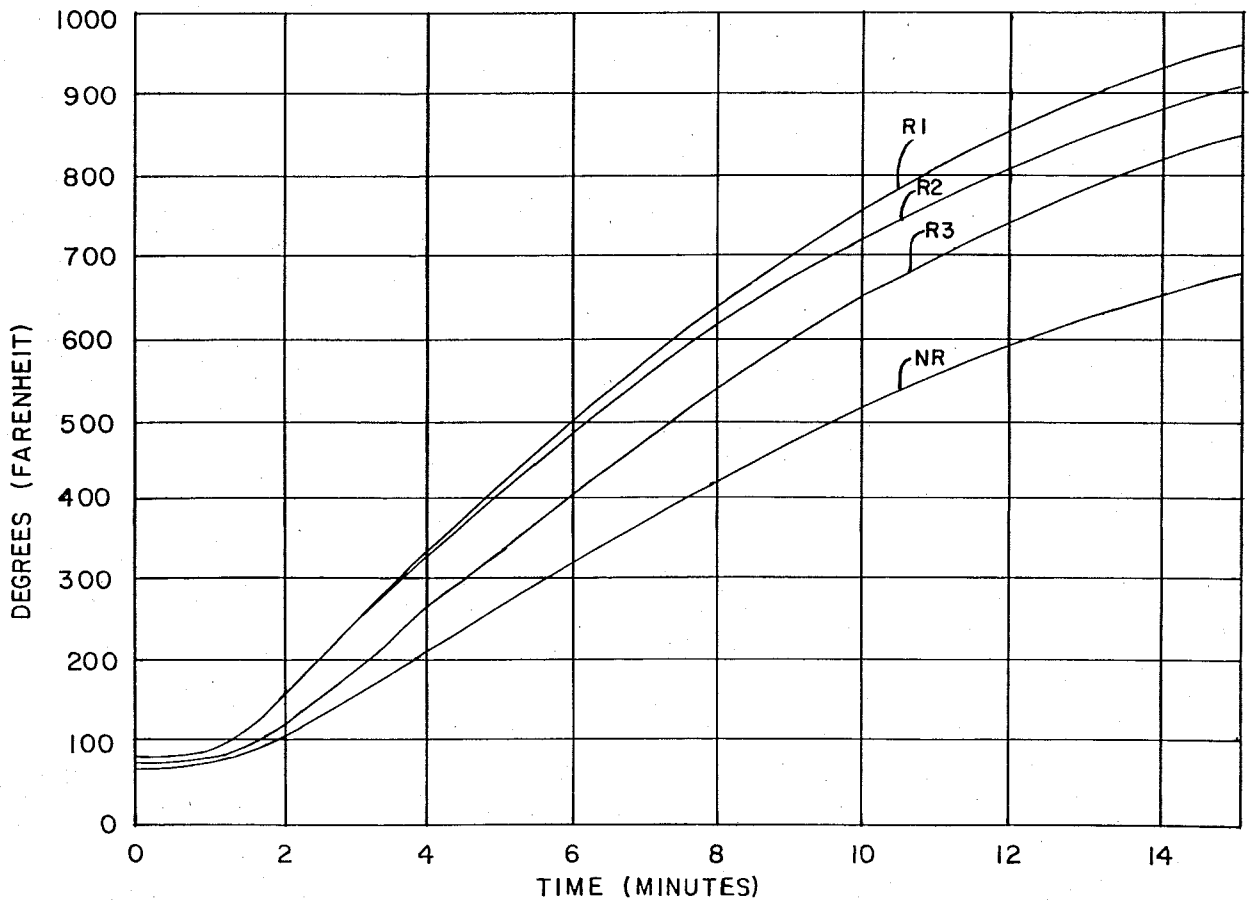
FIG. 10 is a set of representative curves showing the heating rates of various broiling configurations.

Referring to FIG. 10, curves showing representative cooking data are shown. For each curve, temperature measurements were taken using a thermocouple embedded in the center of a 0.5-inch thick pure graphite block that was positioned 1.5 inches below broil element 32. The high emissivity and unchanging surface properties of the graphite block provided a sensitive and consistent indication of the incident thermal energy. Curve R1 is representative of the temperature rise of the graphite block using a new aluminized steel concentrator or reflector such as described with reference to FIGS. 2–4. Curve R2 is representative of the temperature rise using a new concentrator or reflector having a plasma-sprayed aluminum coating over commercial quality aluminized steel. Curve R3 is representative of the temperature rise using an aluminized steel concentrator or reflector that had been subjected to 37 three-hour self-cleaning cycles which is considered to be equivalent to 9.25 life years of normal self-clean cycles. The appearance of the reflector used for curve R3 was noticeably darker than the new aluminum steel reflector used for curve R1. The surface was not uniformly dark but appeared mottled because intermetallic compounds form quicker in some areas than others. Other tests showed that the performance of the aluminized steel reflector did not deteriorate noticeably after 37 self-clean cycles. Curve NR was taken in an oven using a similar heating element 32 without a concentrator 34 or reflector. The test results clearly show that although the rate of temperature rise in the graphite block diminishes slightly as the aluminized steel concentrator 34 darkens due to intermetallic compounds forming as a result of the reflector being subjected to extended use at high temperatures, it is always substantially higher than without a concentrator or reflector. For example, after ten minutes of broiling operation, the graphite block was raised to 648° F. with the darkened and thus less reflective concentrator 34 but was only raised to 512° F. in the same time period when no concentrator was used. Also, while the block reached 500° F. in 6 minutes with a new concentrator 34, it took 7½ minutes with a darkened concentrator and almost 10 minutes using no concentrator. The time savings using the new and darkened concentrator represented time savings 39% and 24%, respectively, in reaching a sufficient broiling temperature. In fact, when using concentrator 34, food temperatures got to broiling temperatures so fast that preheating was not required.

Even though the reflectivity of concentrator 34 reduces through high temperature aging, its broiling performance is only slightly degraded and it is still much more effective and efficient than broiling without a concentrator. One explanation for the relatively small decrease in broiling performance even though the reflectivity is significantly decreased through age is that as it reflects a smaller percentage of the incident radiation from broil element 32, concentrator 34 absorbs more and thereby heats to a temperature whereby it becomes a source of downwardly directed or focused energy rather than just a reflector. Stated differently, the concentrator functions not only as a reflector but also as a primary source of radiation when it becomes heated due to absorption of energy from broil element 32. The total radiation coming from the concentrator is the sum of the two. As the reflectivity of the concentrator diminishes because of its initial light, shiny appearance changing to a dull gray during its life cycle, the amount of reflected energy decreases but the amount of source radiation increases because it heats up more. The geometry and view factor of concentrator 34 are accordingly important not only for its operation as a reflector but also as a primary source of radiation. In addition to being a reflector, concentrator 34 can be viewed as a shield at least partially wrapping around or surrounding the top and sides of individual broil element segments thereby preventing the upward and sideward radiation of infrared energy from the broil element to the oven ceiling 20 and walls 16 and 18. In the process, concentrator 34 absorbs the infrared energy and heats to a temperature whereby it becomes a primary source of radiating energy thereby significantly increasing the downward radiation available for broiling. Because the broil element 32 is recessed into the trough 59, the surface area of concentrator 34 that is closely spaced from broil element 32 is significantly increased whereby it more effectively becomes a source of radiant energy. The shape of trough 59 causes most of that radiant energy to be directed downwardly.

With a conventional oven, the broil element 32 is typically activated at quarter power (120 VAC) during the bake cycle so that foods such as cakes are lightly browned on the top side. Concentrator 34 is so effective and efficient that the bake power of the broil element is reduced to eighth power.

Concentrator 34 also provides a barrier between broil element 32 and ceiling 20 so that higher power broil elements 32 can be used without overheating or damaging the standard porcelein enamel coating on ceiling 20.

This concludes the description of the preferred embodiments. Many modifications and alterations will come to mind to those skilled in the art without departing from the spirit and scope of the invention. Therefore, it is intended that the invention be limited only by the claims.

What is claimed is:

1. An electric oven, comprising;

an oven cavity;

a contoured metal concentrator having a serpentine-shaped downwardly facing trough;

a rod-like sheathed electric resistive broiling element having a section substantially conforming to the shape of said serpentine trough, said section having a diameter substantially smaller than the entrance to said trough, said section being recessed within said trough and connected thereto wherein a portion of the energy radiated from said broiling element in an upward or sideward direction is reflected to a downward direction; and means for activating said broiling element.

2. The oven recited in claim 1 wherein said contoured metal concentrator is aluminized steel.

3. The oven recited in claim 1 wherein said serpentine shape defines a plurality of parallel segments interconnected by curved end segments.

4. The oven recited in claim 1 wherein said entrance to said trough is at least four times wider than said diameter of said section of said resistive broiling element and said section is completely recessed into said trough wherein the sides of said trough extend at least down to the underside of said section.

5. The oven recited in claim 4 wherein said section is recessed approximately one-third of the depth of said trough.

6. The oven recited in claim 1 further comprising means for self-cleaning said cavity.

7. An electric oven, comprising:

an oven cavity;

a contoured aluminized steel reflector defining a downward facing serpentine trough having a plurality of parallel segments interconnected at the ends with curved segments;

a sheathed electric resistive broiling rod having a portion with a shape substantially conforming to said serpentine trough, said rod having a diameter less than one-quarter the width of the entrance into said trough, said rod being substantially recessed within said trough wherein the sides of said trough substantially surround said portion of said rod whereby radiation having an upward or strong horizontal component from said rod is incident upon said trough for redirection in a downward direction; and means for activating said broiling rod.

8. The oven recited in claim 7 wherein said portion of said rod recessed in said trough is substantially spaced therefrom.

9. The oven recited in claim 7 wherein the steady state temperature of said rod is in the range from 1500° F. to 1700° F.

10. An electric self-clean oven, comprising: an oven cavity;

a sheathed electric resistive broiling rod having a curved section disposed in a substantially horizontal plane adjacently spaced from the top of said cavity;

means for activating said broiling rod to produce radiant energy; and an aluminized steel reflector having a contour defining a downwardly facing trough substantially conforming to the shape of said curved section of said broiling rod, said section of said broiling rod being recessed up into said trough wherein upper and side portions of said section are spaced from and adjacently surrounded by said trough for concentrating said radiant energy downwardly to broil food.

11. An electric self-clean oven, comprising:

an oven cavity;

an elongated sheathed electric resistive heating element positioned near the top of said cavity for broiling food, a section of said heating element having a serpentine shape defined by a plurality of parallel segments interconnected by curved end segments;

means for providing an electric current through said resistive heating element; and a contoured metal concentrator defining a downward facing trough substantially conforming to said serpentine shape, said trough being substantially larger than the diameter of said heating element and said heating element being substantially recessed up into said trough wherein the sides of said trough are spaced from and surround the top and sides of said parallel segments for redirecting upwardly directed radiation from said heating element downwardly.

12. The oven recited in claim 11 wherein said concentrator is aluminized steel.

13. An electric self-clean oven, comprising:

an oven cavity defined by side walls, a back wall, a ceiling, a floor, and a front door;

a first elongated sheathed electric resistive heating element curvedly disposed in a substantially horizontal plane adjacently spaced from said floor;

means for providing an electric current through said first heating element;

a second elongated sheathed electric resistive heating element curvedly disposed in a substantially horizontal plane adjacently spaced from said ceiling, a portion of said second heating element having a serpentine shape defined by a plurality of parallel segments interconnected by curved end segments;

means for providing an electric current through said second heating element; and a contoured aluminized steel concentrator defining a downward facing trough substantially conforming to said serpentine shape, said trough having an entrance which is wider than an inch and at least four times larger than the diameter of said second heating element, said trough having a height of less than one inch, said second heating element being recessed up in said trough approximately one third of said height to concentrate radiant energy from said second heating element downwardly.

14. The oven recited in claim 13 wherein a portion of the cross-section of said trough has a substantially parabolic shape.

15. An electric self-clean oven, comprising:

an oven cavity defined by side walls, a back wall, a floor, a ceiling, and a front door;

a sheathed electric resistive broiling rod disposed in a substantially horizontal plane adjacent to said ceiling of said cavity, said rod having a plurality of interconnected segments;

means for activating said broiling rod to provide radiant energy; and a plurality of downward facing metal troughs respectively positioned between said plurality of broiling rod segments and said ceiling, said troughs being spaced from said respective broiling rod segments and having sides extending downwardly past said respective broiling rod segments wherein said radiant energy emitted from said segments in a direction having an upward vertical or strongly horizontal component impinges said respective troughs, said troughs reflecting a portion of said impinging radiant energy in a downward direction.

16. The oven recited in claim 15 wherein said troughs are fabricated of aluminized steel.

17. The oven recited in claim 15 wherein said troughs have a cross-section defining a substantially parabolic shape.

18. The oven recited in claim 15 wherein a portion of said impinging radiant energy is absorbed by said troughs wherein said troughs heat to a temperature providing a source of thermal energy on food being broiled.

* * * * *